US011045030B2

(12) United States Patent
Hong

(10) Patent No.: US 11,045,030 B2
(45) Date of Patent: Jun. 29, 2021

(54) TIERED HANGER

(71) Applicant: Whitmor, Inc., Southaven, MS (US)

(72) Inventor: He Hong, Guangxi (CN)

(73) Assignee: Whitmor, Inc., Southaven, MS (US)

( * ) Notice: Subject to any disclaimer, the term of this patent is extended or adjusted under 35 U.S.C. 154(b) by 0 days.

(21) Appl. No.: 16/282,012

(22) Filed: Feb. 21, 2019

(65) Prior Publication Data

US 2019/0239671 A1 Aug. 8, 2019

Related U.S. Application Data

(63) Continuation-in-part of application No. 29/636,173, filed on Feb. 6, 2018, now Pat. No. Des. 844,335.

(51) Int. Cl.

| | |
|---|---|
| ***A47G 25/18*** | (2006.01) |
| ***A47G 25/16*** | (2006.01) |
| ***A47G 25/20*** | (2006.01) |
| ***A47G 25/14*** | (2006.01) |

(52) U.S. Cl.

CPC ..... *A47G 25/183* (2013.01); *A47G 25/145* (2013.01); *A47G 25/16* (2013.01); *A47G 25/186* (2013.01); *A47G 25/20* (2013.01)

(58) Field of Classification Search

CPC .... A47G 25/183; A47G 25/145; A47G 25/16; A47G 25/186; A47G 25/20; A47G 25/18; A47G 25/24; A47G 25/30; A47G 25/40; A47G 25/52; A47G 25/1442; A47G 25/1457

USPC ..... D6/315, 317, 328

See application file for complete search history.

(56) References Cited

U.S. PATENT DOCUMENTS

| | | | | | |
|---|---|---|---|---|---|
| 1,039,359 | A | * | 9/1912 | Brown | A47G 25/30 211/118 |
| 2,158,616 | A | * | 5/1939 | Blameuser | A47G 25/746 211/100 |
| 2,303,678 | A | * | 12/1942 | Bracken | A47G 25/14 223/88 |
| 2,593,356 | A | | 4/1952 | Smith | |
| 2,723,765 | A | | 11/1955 | Meredith | |
| 2,866,583 | A | * | 12/1958 | Batts | A47G 25/30 223/88 |

(Continued)

FOREIGN PATENT DOCUMENTS

DE 894312 C * 10/1953

*Primary Examiner* — Ismael Izaguirre
(74) *Attorney, Agent, or Firm* — Stites & Harbison PLLC; Richard S. Myers, Jr.

(57) ABSTRACT

A garment storage apparatus that comprises a hanger support frame and at least one hanger releasably resting on the hanger support frame; the hanger support frame comprising: an upper support, a lower support, a right support, a left support; with the upper support joining the top portion of the left and right supports and the lower support joining the bottom portions of the left and right supports; a first hanger hook on the left support and a corresponding first hanger hook on the right support, and a second hanger hook on the left support and a corresponding second hanger hook on the right support; the hanger comprising: a crown, and arms extending outwardly from the crown, with the crown having a horizontal length at least the same distance as the distance of the corresponding hanger hooks on the left and right supports so that the hanger can be removably placed on the corresponding hanger hooks.

11 Claims, 11 Drawing Sheets

(56) References Cited

U.S. PATENT DOCUMENTS

| | | | | | |
|---|---|---|---|---|---|
| 2,998,172 | A | | 8/1961 | Stefano | |
| 3,348,745 | A | * | 10/1967 | Basile | A47G 25/24 223/88 |
| 3,584,746 | A | | 6/1971 | Marchman | |
| 4,058,222 | A | * | 11/1977 | Singer | A47G 25/18 211/118 |
| 4,261,490 | A | | 4/1981 | Schwartzstein | |
| 4,709,838 | A | | 12/1987 | Campbell | |
| 4,811,852 | A | * | 3/1989 | Kelly | A47G 25/743 211/119 |
| 5,040,707 | A | | 8/1991 | Ayano | |
| 5,107,996 | A | | 4/1992 | Whittaker | |
| D327,579 | S | | 7/1992 | Fildan | |
| D360,533 | S | * | 7/1995 | Williams | D6/315 |
| D433,821 | S | | 11/2000 | Brutus | |
| 6,273,280 | B1 | * | 8/2001 | Markarian | A47G 25/1464 211/113 |
| 6,675,997 | B1 | | 1/2004 | Gouldson | |
| D498,936 | S | | 11/2004 | Gouldson | |
| 8,397,961 | B2 | | 3/2013 | Viehe | |
| 9,060,635 | B1 | | 6/2015 | Neal | |
| 2004/0144812 | A1 | | 7/2004 | Chen | |
| 2013/0075434 | A1 | | 3/2013 | Hilmer et al. | |
| 2013/0087587 | A1 | | 4/2013 | Hickey et al. | |

* cited by examiner

TIERED HANGER

PREVIOUS APPLICATIONS

The application is a continuation-in-part of U.S. patent application Ser. No. 29/636,173 filed on Feb. 6, 2018, the contents of which are incorporated herein by reference.

TECHNICAL FIELD

The presently-disclosed subject matter relates to the technical field of organization and storage systems. More particularly, certain embodiments of the present invention relate to a plurality of garment hangers supported by a single hook. The presently-disclosed subject matter further relates to devices capable of storing multiple clothing items in a compact area.

BACKGROUND

Closets, wardrobes and assorted types of clothing racks usually consist of at least one bar, hook, or grate with which to hang clothes using standard hangers. However, regardless of the method, there is always a finite amount of storage. As clothing is added to the bar or rack, sorting through and displaying the clothing becomes increasingly difficult. In an attempt to overcome this challenge various inventions have implemented vertical storage solutions to optimize limited storage space.

Some storage solutions use a vertical hinging mechanism whereby a device contains pivoted hooks at two ends and can suspend the bar horizontally across a closet bar. Clothes can then be hung on the suspended hanger and one of the hooks subsequently released allowing the device to hang vertically.

Other attempts to increase storage space have included vertically oriented devices where a single hanger hook provides a plurality of places to suspend additional hangers in vertical fashion. Some of these vertical devices are uni-body designs whereas others provide hooks for individual hangers.

However, both the pivoted hook and vertical devices have several shortcomings which the present-invention seeks to redress. Current vertical uni-body tiered hanger designs lack customizability, easy retrieval or addition of clothing, and the overwhelming majority available contain tiers for the same types of clothing, i.e. all pant hangers. Further still, the vertical tiered hangers easily tilt along the horizontal axis at the point where the hangers are connected to the main hanger body. The tilting causes clothing to become entangled or slip off the hangers. The tilting is substantially caused by the hangers being attached to a central body at a single pivot point. Other tiered hanger designs attempting to increase accessibility to hung clothing garments contain multiple hinges and moving parts which incurs considerable stress during the life of the hanger resulting in product failure over time.

For example, U.S. Pat. No. 4,058,222 to Singer discloses a multiple clothes hanging device that is described as a multiple garment hanging device. It employs a plurality of hanger slides that rest upon an elongate track. The slides comprise a garment hanger. The slides are slidably mounted on the track. Each slide and its associated hanger may be removed from the track member independently of the remaining slides by rocking the selected slide a predetermined amount, permitting it to be withdrawn. The slides located above the withdrawn slide move down the track member to fill the gap. The withdrawn slide is remounted at the top of the track member.

U.S. Pat. No. 4,709,838 discloses an apparatus for hanging articles of clothing that comprises an elongated vertically extending article hanging means that includes a plurality pf vertically spaced oppositely facing hook portions.

U.S. Pat. No. 8,397,961 to Viehe discloses a clothing storage apparatus that comprises an upside-down L-shaped body with an upper horizontal arm which includes two parallel hooks used to hang the apparatus from a standard closet bar, and a lower vertical arm which includes a rear-mounted brace that may be adjusted to support the apparatus against the rear wall of a closet, and a plurality of hanger arrays depending from the lower vertical arm, with each hanger array comprising a plurality of hanger members.

U.S. Pat. No. 3,584,746 to Marchman discloses a multiple garment hanger that has a plurality of hanger sections mounted on a member which is adapted to pivot outwardly and upwardly. A hook is connected to the pivoted member for supporting the three sections on a hook or pole.

In view of the deficiencies of prior attempts to create an efficient and practical vertical hanger, there remains a need in the art for storage solutions for clothing that optimizes storage space, is low cost in manufacturing, is durable, is customizable, allows for easy retrieval, and does not allow easy tilting in the horizontal axis when clothing is retrieved or hung.

One aspect of the present-invention provides tiered hangers that provide customizable clothing storage solutions while storing articles of clothing in a closet, wardrobe, or rack.

Another aspect of the present-invention provides a means to prevent articles of clothing from becoming entangled and slipping off the hangers.

Another aspect of the present-invention provides a means to prevent secondary hangers from moving horizontally side-to-side when clothing items are added or retrieved.

A further aspect of the present-invention provides a means to allow clothing articles to be readily retrievable from a closet, wardrobe, or rack.

Another aspect of the present-invention provides a means to easily retrieve articles of clothing without incurring stress on the product.

A further aspect of the present invention provides a means to decrease manufacturing cost.

SUMMARY OF THE INVENTION

The presently-disclosed subject matter meets some or all of the above-identified needs, as will become evident to those of ordinary skill in the art after a study of information provided in this document.

This Summary describes several embodiments of the presently-disclosed subject matter, and in many cases lists variations and permutations of these embodiments. This Summary is merely exemplary of the numerous and varied embodiments. Mention of one or more representative features of a given embodiment is likewise exemplary. Such an embodiment can typically exist with or without the feature(s) mentioned; likewise, those features can be applied to other embodiments of the presently-disclosed subject matter, whether listed in this Summary or not. To avoid excessive repetition, this Summary does not list or suggest all possible combinations of such features.

The presently-disclosed subject matter includes a tiered hanger devices comprising a main body with a means to hang from a standard closet bar, wardrobe, or rack, a plurality of horizontally elongated hooks, that are integrally affixed to the body. Each hook is capable of supporting a secondary hanger that further contains a rectangular shaped protrusion wherein said protrusion is substantially the same width as the horizontally elongated hooks. The hook contacts the protrusion to create at least two pivot points. The secondary hanger being readily removable from the hook.

In some embodiments, the secondary hanger is a specialty hanger for pants.

In some embodiments, the secondary hanger is a specialty hanger for suit jackets.

In other embodiments, the secondary hanger is a specialty hanger for shirts or blouses.

In another embodiment, the secondary hangers on a single main body may be comprised of pants hangers, shirt hangers, suit jacket hangers, or combinations thereof.

BRIEF DESCRIPTION OF THE DRAWINGS

Illustrative and preferred embodiments of the present invention are shown in the accompanying drawings in which.

DETAILED DESCRIPTION OF EXEMPLARY EMBODIMENTS

Figure 1:
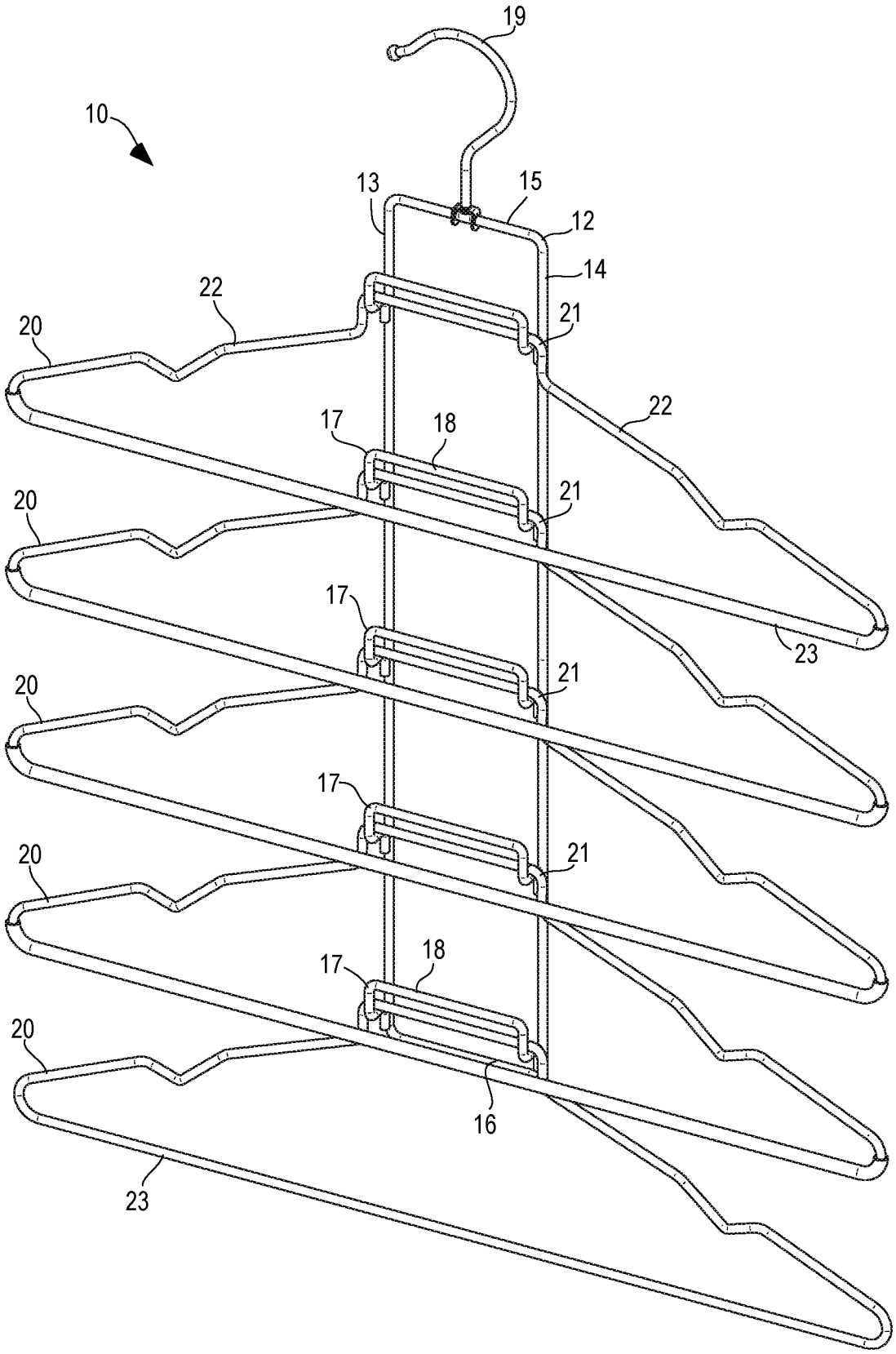
FIG. 1. shows a tiered hanger apparatus (10) containing secondary shirt hangers. The main hanger body or frame (12) contains hanger hooks (17) for supporting secondary shirt or pant hangers (20). The secondary shirt hangers (20) are hung on the hooks (17) through the use of a rectangular protrusion (21). Also visible on the main hanger body (12) is a means with which to hang the tired hanger from a standard closet bar, in this case an upper hook (19).

The details of one or more embodiments of the presently-disclosed subject matter are set forth in this document. Modifications to embodiments described in this document, and other embodiments, will be evident to those of ordinary skill in the art after a study of the information provided in this document. The information provided in this document, and particularly the specific details of the described exemplary embodiments, is provided primarily for clearness of understanding and no unnecessary limitations are to be understood therefrom. In case of conflict, the specification of this document, including definitions, will control.

It will be understood that various details of the presently disclosed subject matter can be changed without departing from the scope of the subject matter disclosed herein. Furthermore, the foregoing description is for the purpose of illustration only, and not for the purpose of limitation.

While the terms used herein are believed to be well understood by those of ordinary skill in the art, certain definitions are set forth to facilitate explanation of the presently-disclosed subject matter.

As used herein, the term "about," when referring to a value or to an amount of mass, weight, time, volume, concentration or percentage is meant to encompass variations of in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed method.

As used herein, ranges can be expressed as from "about" one particular value, and/or to "about" another particular value. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the term secondary hanger refers to hangers designed to optimally hang certain items of clothing.

As used herein, the term secondary pants hanger refers to hanger designs that are optimally designed to hang or drape pants.

As used herein, the term secondary shirt hanger refers to hangers designed to optimally hang tee-shirts, blouses, collared shirts, sweatshirts, sweaters, and the like (and in many cases, pants as well.

As used herein, the term secondary jacket hanger refers to hangers designed to optimally hang clothing items such as sport jackets, suit jackets, formal coats, and the like.

As used herein, the term "integrally affixed" refers to features that are permanently affixed or nearly permanently affixed to one another. Techniques that would cause two features to become integrally affixed include, but are not limited to, unibody design, soldering, permanent clasps, and the use of adhesives.

As used herein the term "standard closet bar" can also include garment bars in wardrobes, clothing racks, or commercial clothing racks.

Figure 2:
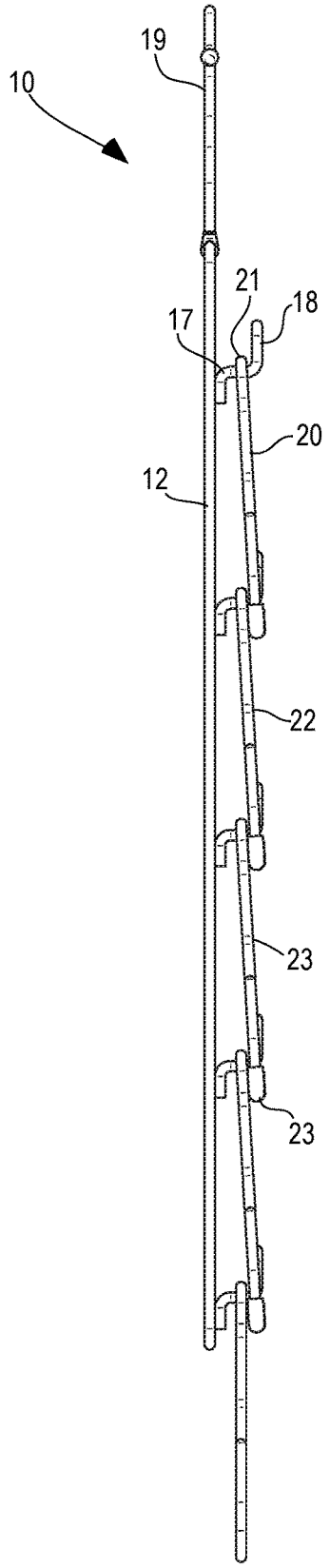
FIG. 2. shows a left side view of the tiered hanger apparatus (10) of FIG. 1. containing secondary hangers such as shirt or pant hangers. The main hanger body or support frame (12) contains hooks (17) for supporting secondary hangers and in the case of this figure, shirt or pant hangers (20). The secondary hangers (20) typically removably hang on the hooks (17).

Referring to an embodiment of the present invention in more detail, in FIG. 1 and FIG. 2, an example of a tiered hanger apparatus (10) of the present invention is illustrated. This particular hanger apparatus is coupled with shirt hangers of the present invention. As with typical shirt hangers, they can also or alternatively hang pants as well. The tiered hanger apparatus of this embodiment comprises main hanger body/support frame (12); which comprises hooks (17) for supporting secondary hangers (20), and an upper hook (19) to hang the support frame from a standard closet bar, wardrobe bar, or clothing rack. Each secondary hanger (20) is removable from the support frame and can be placed in multiple positions on the support frame by engaging different sets of hanger hooks (17).

Embodiments of the support frame are generally rectangular in shape and include a left support bar (13) and a right support bar (14). The left and right support bars are connected by an upper support (15) and a lower support (16). The left and right support bars also include a plurality of secondary hanger hooks (17). The hanger hooks on the left support bar are spaced evenly with a same number of hooks on the right support bar to form a corresponding set of hanger hooks. The hanger hooks may simply extend outward and upward from the support bars. The hooks on the left support bar are joined with the hooks on the right support bar by an upper hook bar (18). The upper hook bar is typically about the same length of the upper and lower supports.

The hanger (20) rests on the hooks (17). The upper hook bar (18) that joins the hooks is higher than the lower portion of the hanger hook that extends outward from the support frame. This arrangement allows the upper hook bar to assist on holding the hanger in place against or next to the frame.

The hanger (20) depicted in FIG. 1 is ideal for hanging shirts and pants. This embodiment includes two hanger arms (22) that are joined by a hanger base (23). Pants can hang on the hanger base, and the arms can support hanging shirts. The hanger base (23) can be of a different material and/or thickness to better support pants and prevent them from slipping off the hanger. Additionally, or alternatively, the hanger base can be coated or covered with a more tacky material than the arms to prevent pants from slipping off the hanger. The material may be a polymeric material, for example. Other examples include pulp-based materials, felt or a felt-like material. The two arms of the hanger are joined by a hanger crown (21). The hanger crown is generally flat. It is generally longer in length than the upper hook bar (18) and the distance between the right and left support bars, so that when the hanger is hanging on the apparatus, the hooks (17) and upper hook bar (18) hold the hanger in place. In embodiments, the hanger crown rests snugly on the hooks.

The tiered hanger apparatus of the present invention stores a plurality of hangers. The embodiment shown in FIG. 1 holds five hangers. Of course, this number is not critical. Embodiments can include an apparatus that holds two, any number up to 10, and more than 10.

As mentioned herein, the apparatus of the present invention can be made from a number of materials. Examples include polymer-based materials, wood, or metal. There can also be combinations. For example, the support frame (12) can be metal, and the hangers can be plastic or wooden. The apparatus can also be coated. For example, the support frame can be metal with at least a portion, such as the upper hook, hooks, and/or the upper hook bar can be coated with a polymer material.

Figure 3:
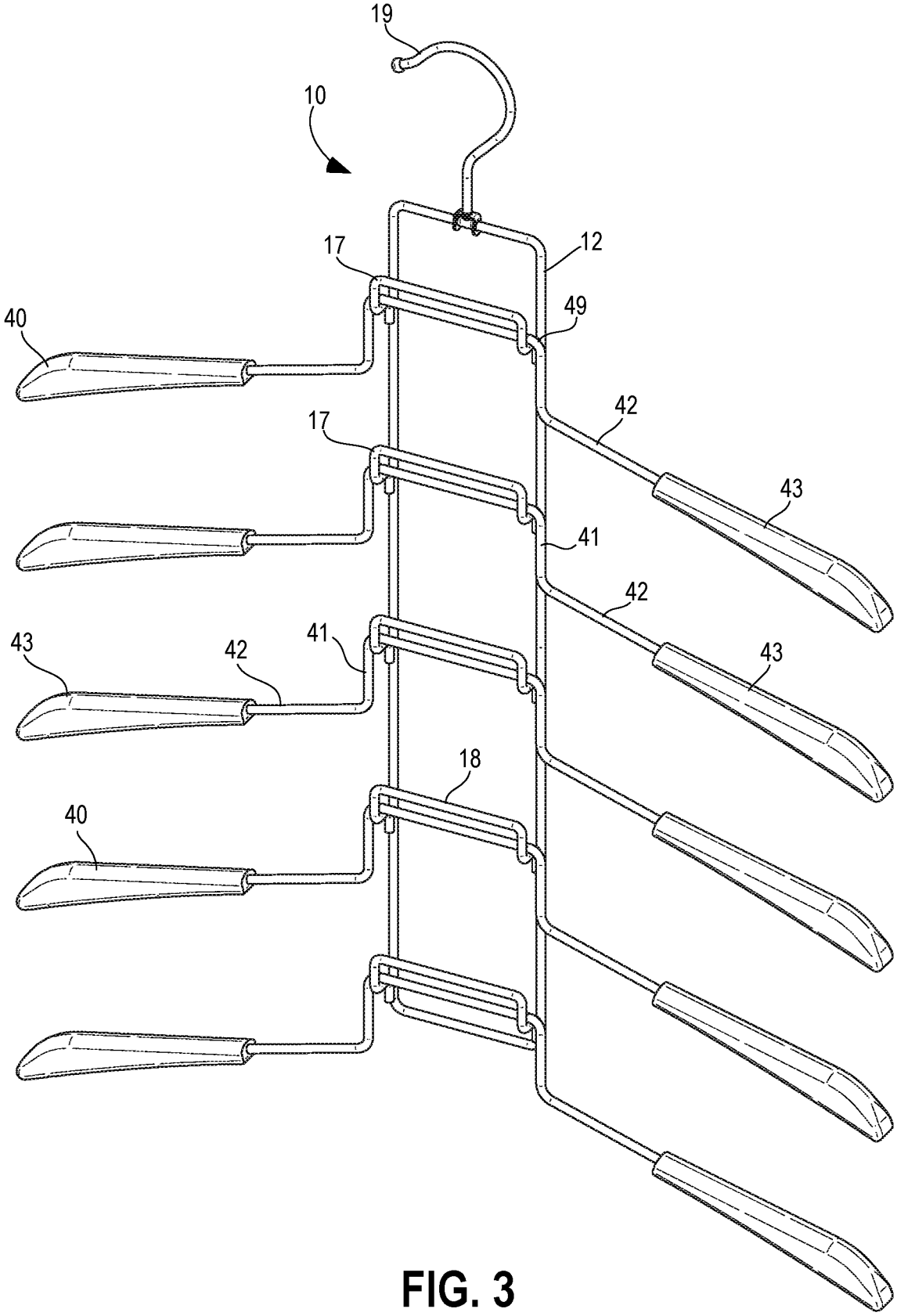
FIG. 3 shows a tiered hanger apparatus containing secondary hangers that are particularly suitable as jacket/coat hangers. The main hanger body or support is the same as shown in FIG. 1. The secondary jacket hangers (40) include a hanger crown (49), hanger arms (42) and a jacket support (43).
Figure 4:
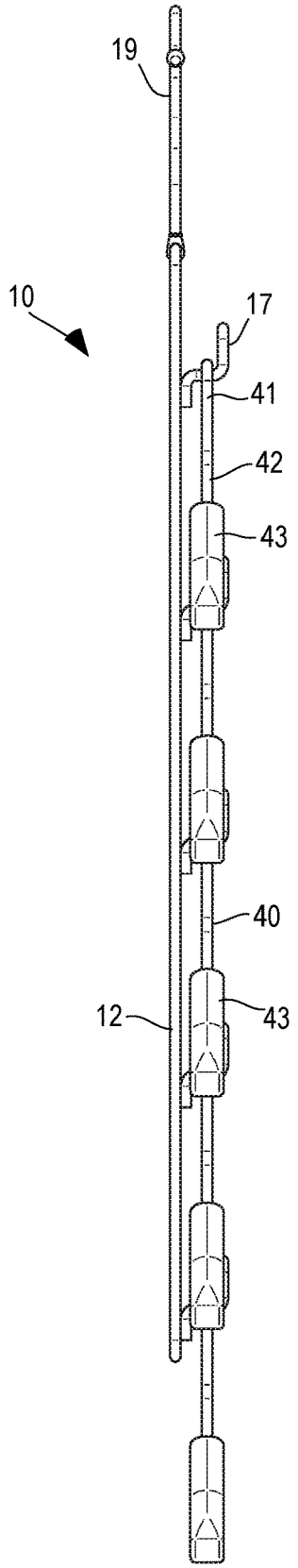
FIG. 4 shows a left side view of the tiered hanger apparatus of FIG. 3. including secondary jacket hangers.

Another embodiment of the present invention is shown in FIG. 3 and FIG. 4, a tiered hanger apparatus (10) for hanging jackets is illustrated. The support frame (12) is the same support frame shown in FIGS. 1 and 2. Thus, the support frame of this embodiment has the same upper hook (19), left support bar (13), right support bar (14), upper and lower support bars (15), (16), hanger hooks (17) and upper hook bar (18) that joins the hooks.

The embodiment of FIG. 3 and FIG. 4 includes secondary hangers (40) that are especially suitable hanging coats or jackets. The secondary hangers fit over the support frame hooks in the same manner as the hangers (20) shown in FIGS. 1 and 2. Accordingly, they also include a hanger crown (41), and hanger arms (42). Since these hangers (40) are especially suitable for hanging jackets, there is no need for the hanger base (23) that appears in the hanger (20). The hanger arms can include a jacket support (43) on the hanger arms (42) that help support the jacket and help maintain its shape when hanging. The jacket supports can be made from many different materials as well.

Figure 5:
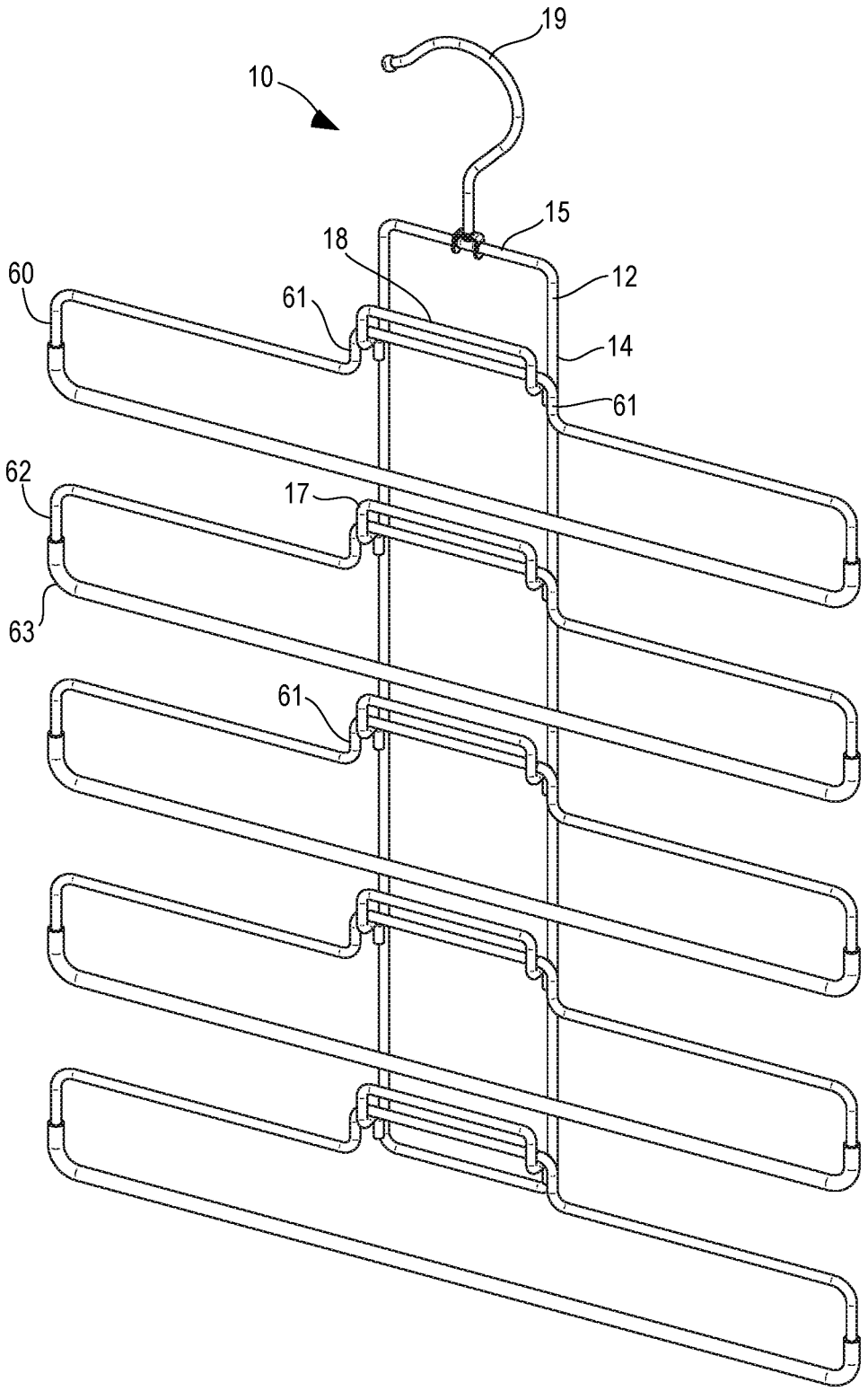
FIG. 5 shows a tiered hanger apparatus containing secondary hangers particularly suitable as pant hangers. The main hanger body and support is the same as shown in FIG. 1. The secondary pant hangers include a hanger crown (61), a hanger arm (62) and a hanger base (63).
Figure 6:
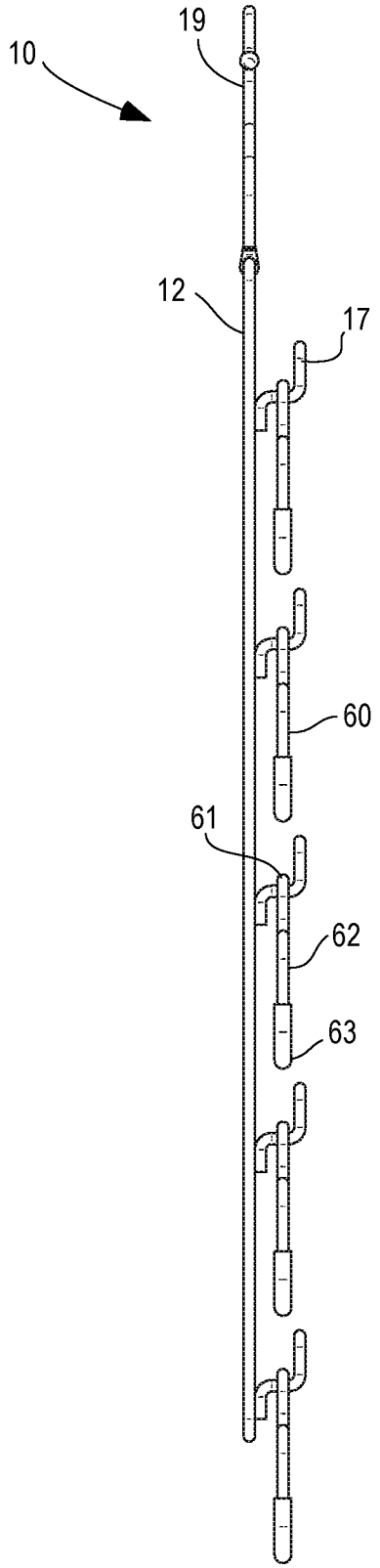
FIG. 6 shows a left side view of the tiered hanger apparatus of FIG. 5. including secondary jacket hangers. Shows a left side view of the tiered hanger apparatus of FIG. 5. containing secondary pants hangers. The main hanger body (1) contains hooks (2) for supporting secondary pants hangers (7). The secondary jacket hangers (7) are hung on the hooks (2).

The embodiment of FIGS. 5 and 6 show an embodiment of the present invention that includes secondary hangers (60) that are especially suitable for hanging pants. The secondary hangers fit over the support frame hooks in the same manner as the hangers (20) shown in FIGS. 1 and 2. Accordingly, they also include a hanger crown (61), hanger arm (62), and a hanger base (63). Like the other secondary hangers, the hangers of this embodiment can be made out of many different materials. An additional option, one that this shown in FIGS. 5 and 6, is the hanger base (63) being constructed of, or coated with a material that provides friction and/or tackiness to a pant hanging on the base. For example, the hanger base can be coated in a polymeric or felt material. The pant hangers attach to and are removed from the support frame in the same manner as the other secondary hangers. That is, the hanger crown rests on the hook that is on the left support bar (13) and the corresponding hook on the right support bar (14).

Figure 7:
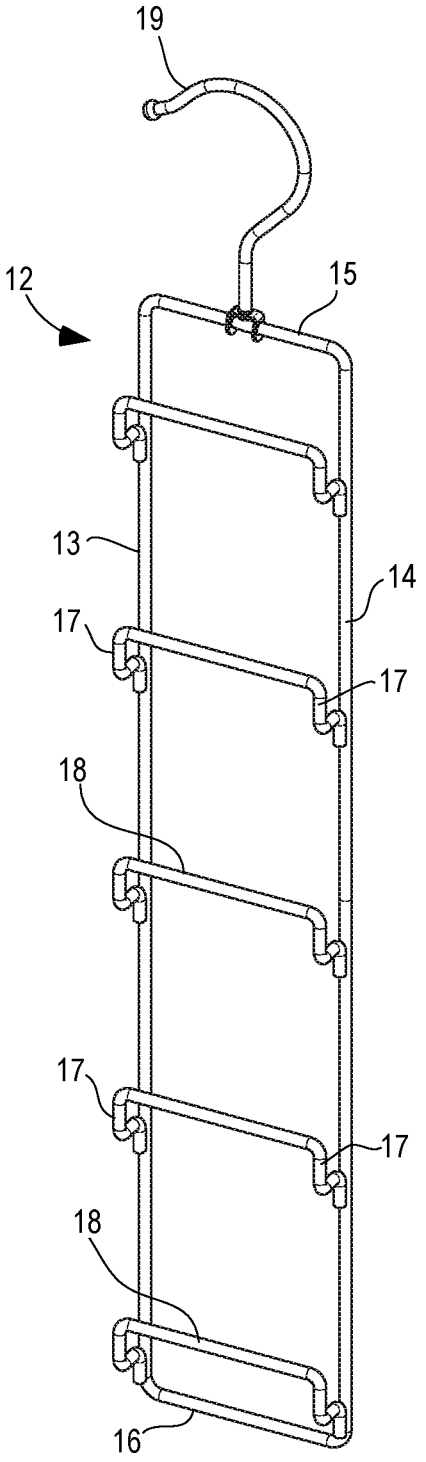
FIG. 7 shows a front perspective view of the main hanger support frame (12), with secondary hanger hooks (17) affixed to the frame.
Figure 8:
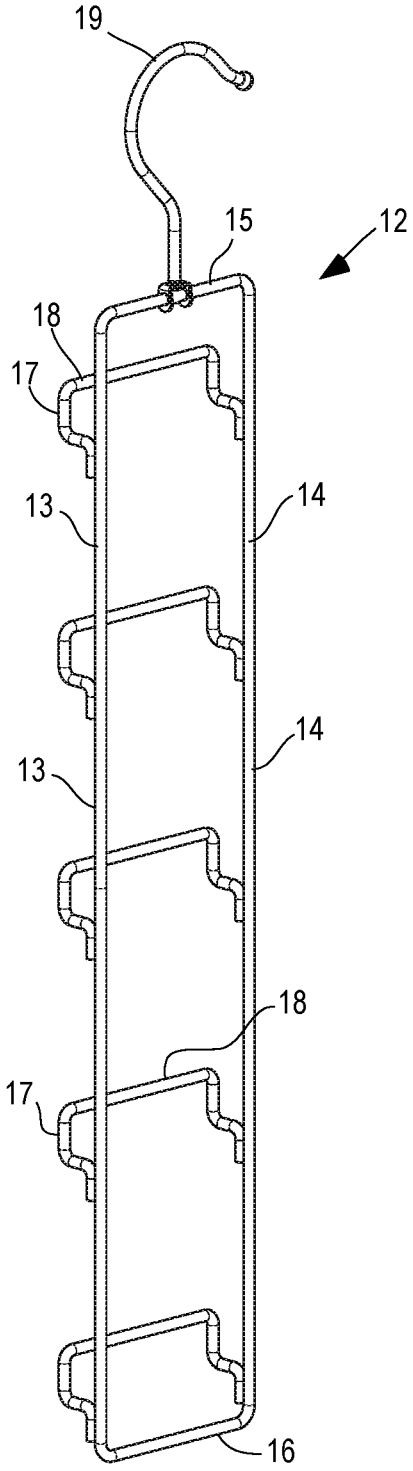
FIG. 8 shows a rear perspective view of the main hanger support frame (12), with secondary hanger hooks (17) affixed to the frame.

FIG. 7 and FIG. 8 show an embodiment of the support frame without the presence of secondary hangers. The support frame is generally rectangular and has an upper support (15) and lower support (16). They join the left support bar (13) and the right support bar (14). The left and right supports are also joined by the secondary hanger hooks. The hooks (17) typically extend outward and upward from the left and right supports. The hooks are joined by an upper bar (18). This also provides support to the frame. Similar to FIG. 1, the support frame in this figure includes 5 hooks. Of course, this present invention is not limited to this number of hooks. Specifically included within the scope of the invention are supports with two hooks, 10 hooks, and any number of hooks in between. Also included are supports with more than 10 hooks.

It is clear from FIG. 7 and FIG. 8 how any of the secondary hangers could be hung from the main hanger body to create a uniform tiered hanger where all the secondary hangers are of the same type or a mixed tiered hanger where the secondary hangers are different types of hangers (i.e., secondary pant hangers and shirt hangers).

Figure 9:
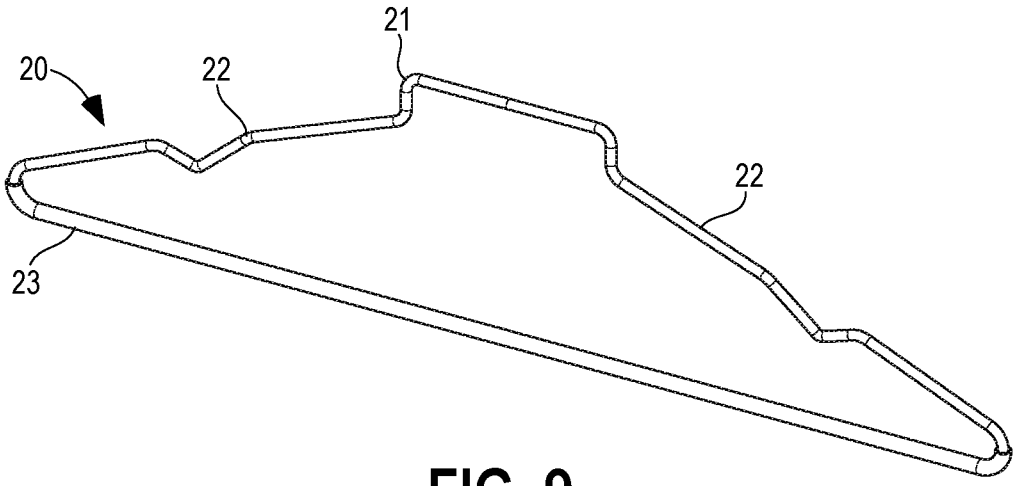
FIG. 9 shows a front perspective view of a secondary shirt hanger (20) of the present invention.
Figure 10:
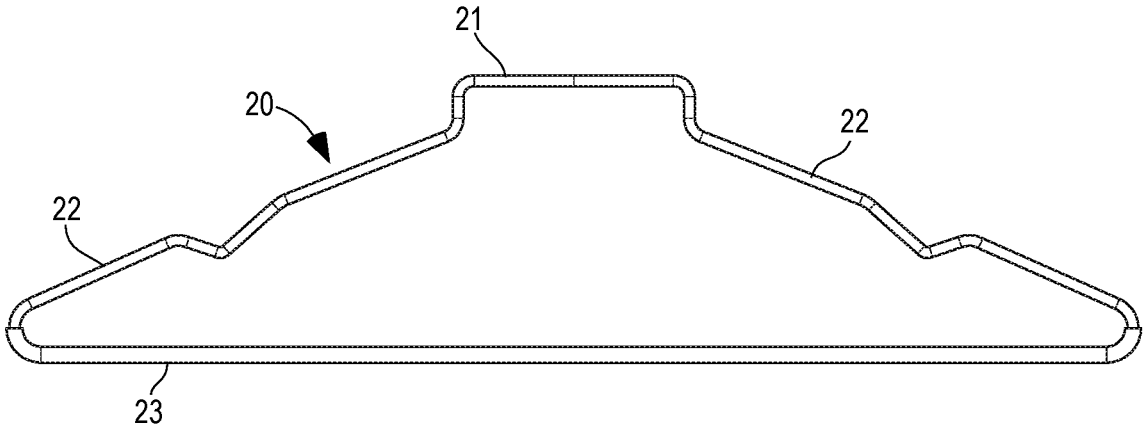
FIG. 10 shows a front view of a secondary shirt hanger (20) of the present invention.

FIG. 9 and FIG. 10 illustrate and example of the shirt/pant secondary hanger (20) embodiment of the present invention. The hanger of this example includes a hanger crown (21), an elongated flat top section that rest over the hooks of the hanger support. Extending outward and downward from the hanger crown are hanger arms (22). The hanger arms support a garment hanging thereon. For example, when a shirt is hanging from the hanger, the hanger arms support the general shoulder area of the garment. Joining the hanger arms at the opposite end of the crown, is the hanger base (23). As mentioned above, the base can be coated with a material to facilitate a garment hanging therefrom. For example, the coating can be a material that possesses more tackiness than the rest of the hanger to provide more friction.

Figure 11:
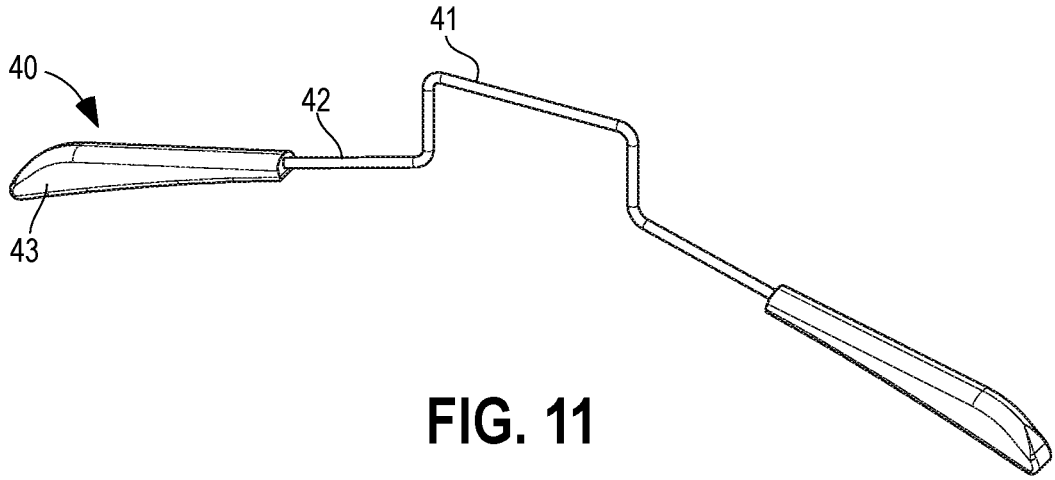
FIG. 11 shows a front perspective view of a secondary jacket hanger (40) of the present invention.
Figure 12:
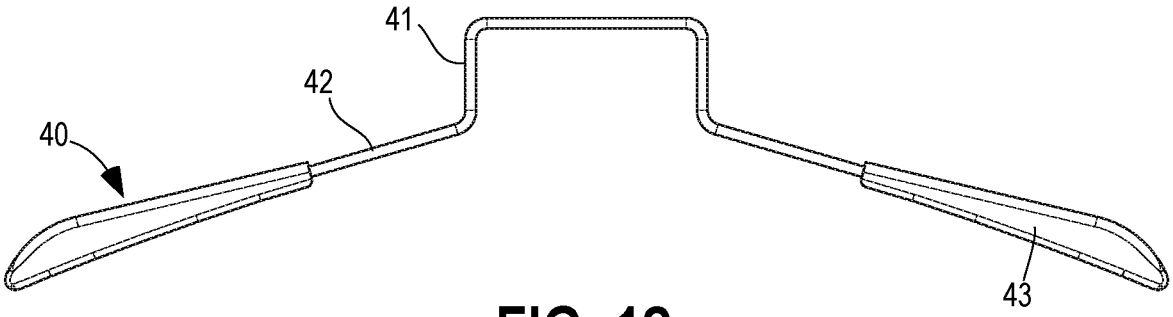
FIG. 12 shows a front view of a secondary jacket hanger (40) of the present invention.

FIG. 11 and FIG. 12 illustrate an embodiment of the present invention that can be used to hang a garment such as a jacket. The hanger of this example includes a hanger crown (41), an elongated flat top section that rest over the hooks of the hanger support. Extending outward and downward from the hanger crown are hanger arms (42). Optionally, garment supports (43) can be incorporated into or on the arms to facilitate hanging a jacket on the hanger. The garment supporters can be plastic, wooden, or any other suitable material.

Figure 13:
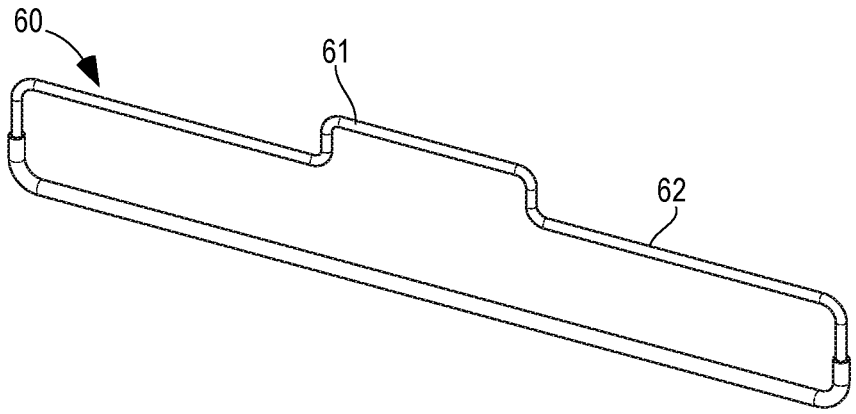
FIG. 13 shows a front perspective view of a secondary pant hanger (60) of the present invention.
Figure 14:
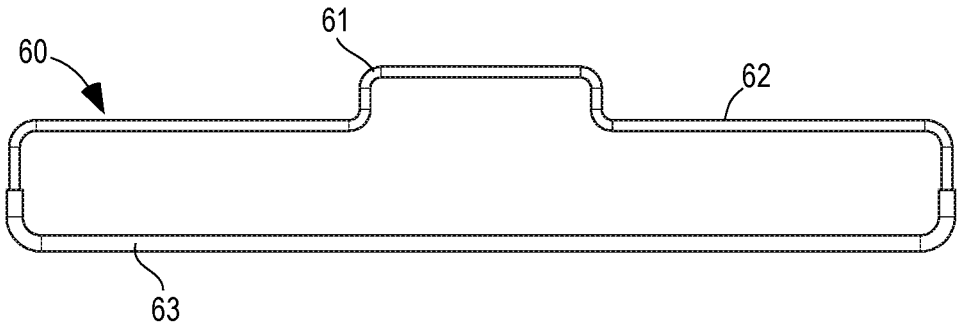
FIG. 14 shows a front view of a secondary pant hanger (60) of the present invention.

FIG. 13 and FIG. 14 illustrate an embodiment of the secondary hanger (60) that can be used for garments such as pants. This hanger also includes a crown portion (61) that rests on the hooks of the support. This hanger also includes a pair of arms (62) and a base (63). To facilitate hanging pants on this hanger, the base (and optionally the lower portion of the arms) can include a coating that provides more friction to the pants hanging thereon. Also contemplated is for the base material to be of a different material and attached to the lower portion of the arms.

Figure 15:
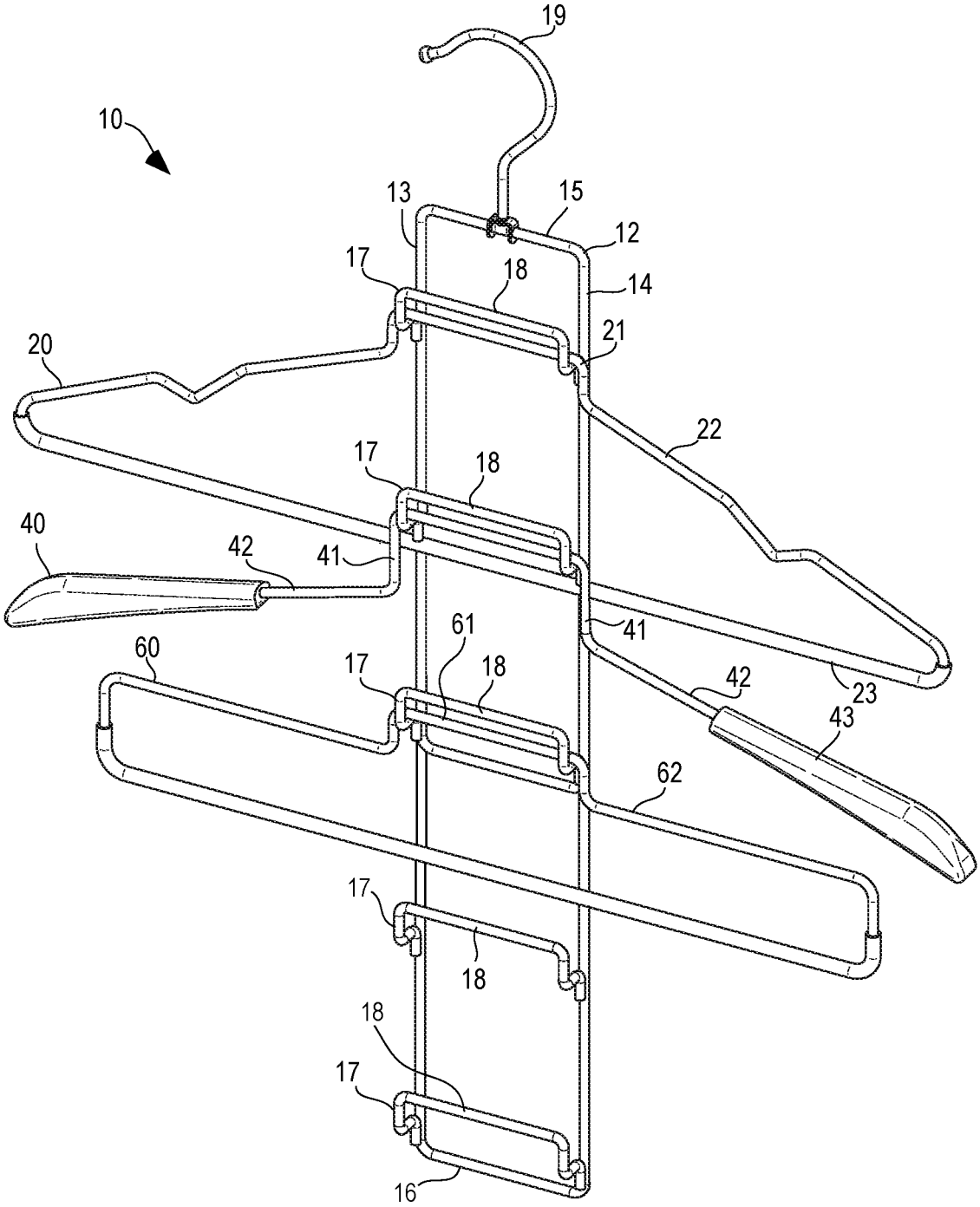
FIG. 15 shows an embodiment of the present invention that includes a main hanger support frame (12), and hanging therefrom a shirt hanger (20), a jacket hanger (40), and a pant hanger (60).

FIG. 15 illustrates an embodiment of the invention that incorporates the support described above, and multiple hangers described above. In this embodiment, hangers (20), (40), and (60) are hanging from the support frame (12). This Figure demonstrates an important feature of the present invention. The type and number of hangers utilized with the present invention is highly interchangeable.

The invention thus being described, it should be obvious that the invention can be modified in many ways. All such modifications should be viewed as an extension of the present invention and not viewed as a departure therefrom.

I claim:

1. A garment storage apparatus, comprising:

a hanger support frame and at least one hanger releasably resting on the hanger support frame;

the hanger support frame comprising:

an upper support, a lower support, a right support, a left support;

with the upper support joining the top portion of the left and right supports and the lower support joining the bottom portions of the left and right supports;

a first hanger hook on the left support and a corresponding first hanger hook on the right support, and a second hanger hook on the left support and a corresponding second hanger hook on the right support, wherein the first and second hooks extend outwardly and upwardly from the support frame;

the hanger comprising:

a crown, and arms extending outwardly from the crown, with the crown having a horizontal length at least the same distance as the distance of the corresponding hanger hooks on the left and right supports so that the hanger can be removably placed on the corresponding hanger hooks.

2. The garment storage apparatus of claim 1, wherein an upper bar joins the corresponding hooks.

3. The garment storage apparatus of claim 2, wherein the hanger is held on corresponding hanger hooks and in between the upper bar and the support frame.

4. The garment storage apparatus of claim 1, comprising three, four, five, or six corresponding sets of hanger hooks on the left and right support bars.

5. The garment storage apparatus of claim 4, comprising at least five, six, or more than six hangers removably resting on corresponding sets of hooks.

6. The garment storage apparatus of claim 1, wherein the hanger further comprises a base that connects the two arms below the crown.

7. The garment storage apparatus of claim 6, wherein the base has a coating.

8. The garment storage apparatus of claim 1, wherein the hanger arms include a jacket pad.

9. The garment storage apparatus of claim 1, wherein a hook is attached to the upper support of the support frame.

10. The garment storage apparatus of claim 1, comprising at least one hanger that has a crown, arms, and base; and at least one hanger that has a crown, arms, and a jacket pad.

11. The garment storage apparatus of claim 1, comprising at least two hangers that have a crown, arms, and base; and at least one hanger that has a crown, arms, and a jacket pad.

* * * * *